United States Patent [19]

Troup

[11] 3,994,466

[45] Nov. 30, 1976

[54] SHROUD FOR PEDESTAL CHAIR

[75] Inventor: Prentice M. Troup, Kensington, Conn.

[73] Assignee: Prentice Corporation, Kensington, Conn.

[22] Filed: June 12, 1975

[21] Appl. No.: 586,198

[52] U.S. Cl. ..... 248/345.1; 248/188.7

[51] Int. Cl.[2] ..... A47B 95/00

[58] Field of Search ..... 222/460, 570; 141/331, 141/340–343; 248/188.1, 188.7, 345, 345.1

[56] References Cited

UNITED STATES PATENTS

| | | | |
|---|---|---|---|
| 2,564,386 | 8/1951 | Webb | 248/345.1 UX |
| 2,992,803 | 7/1961 | Good | 248/188.7 |
| 3,148,855 | 9/1964 | Hamilton | 248/405 X |
| 3,289,995 | 12/1966 | Taylor | 248/345.1 |
| 3,537,623 | 11/1970 | Fisher | 222/460 |
| 3,643,905 | 2/1972 | Kint | 248/345.1 |

FOREIGN PATENTS OR APPLICATIONS

| | | | |
|---|---|---|---|
| 1,404,660 | 5/1965 | France | 248/345.1 |
| 325,790 | 11/1957 | Switzerland | 248/345.1 |
| 951,492 | 3/1964 | United Kingdom | 248/188.7 |

*Primary Examiner*—Lawrence J. Staab
*Attorney, Agent, or Firm*—John J. Hart

[57] ABSTRACT

The shroud has a general frustum-like configuration to provide a central opening through which the chair pedestal extends and to enable the interior surface of the shroud to seat firmly on the chair legs, and when so seated to collectively conceal all of the chair legs. The shroud is made of a compressible resilient plastic of sufficient rigidity to withstand substantial forces applied to those portions of the shroud spanning the areas between the chair legs. Provided on the interior of the shroud are locking means adapted to interengage in locking relation and preferably with a snap action with each leg of the chair.

3 Claims, 11 Drawing Figures

SHROUD FOR PEDESTAL CHAIR

THE INVENTION

This invention relates to furniture and more particularly to a shroud for concealing the legs of a pedestal type of chair.

Pedestal chairs are usually provided with four radially disposed legs projecting outwardly from a central, vertically disposed socket for supporting the pedestal about which the chair swivels. The legs of pedestal type chairs have always been a problem in the furniture art because they are difficult and costly to render attractive and because in usage they become marred, broken and rendered even more unattractive by the frequent scuffing they undergo by a user's shoes. When the legs of this type of chair are made of wood, the art has heretofore mounted a protector at the extremity of each of the legs to reduce the damage thereto in usage. Most of these prior protectors cannot be quickly assembled on the chair, are costly to install, do not give satisfactory wear, and do not improve the appearance of the chair but in fact often diminish its appearance. When the legs of the chair are made of metal such protectors are usually not provided thereon.

As to the pedestal chairs which are provided with metal legs, the most satisfactory solution to the problem has been to provide the legs with finishes of chrome, copper, nickel and stainless steel, all of which involve elaborate costly procedures in the attainment of a satisfactory product. Even though the appearance and marproof qualities of the metal chair legs so treated are enhanced, the configuration of such legs remains the same so that the usual crude, spidery general appearance of this type of chair is substantially unchanged.

The principal object of this invention is to provide a shroud capable of materially improving the appearance of pedestal chairs to the extent that they assume artistic qualities.

Another object of the invention is to provide a chair leg shroud that is capable of transforming the appearance of a pedestal chair by collectively concealing the legs of such a chair.

A further object of the invention is to provide a pedestal chair shroud that is inexpensive to manufacture and can readily be mounted on a chair without the use of tools.

Other objects of the invention as well as the advantages thereof will become apparent from a perusal of the following description when read in connection with the accompanying drawings, in which FIG. 1 is a perspective view of the usual type of pedestal chair provided with metal legs;

Figure 1:
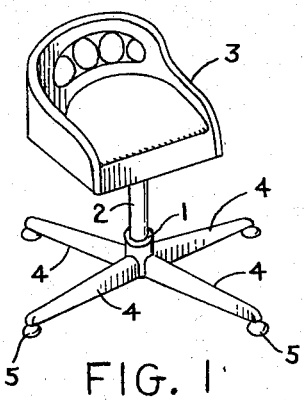

As shown in FIG. 1 of the drawings, a pedestal type chair has a base composed of a central socket 1 in which is seated the bottom end of the pedestal 2 which supports the chair seat 3. Extending radially from the central socket 1 are four legs 4 which have provided at their extremities the chair feet which may be in the form of castors or the glides 5 illustrated. The legs 4 are made of cold rolled steel and are U-shaped in cross-section as is shown more clearly in FIG. 7 of the drawings. In view of the fact that such legs are practically concealed by the shroud of this invention they do not require any finish other than an anti-rust coating if this is considered desirable. The inner ends of the legs 4 are welded to the central socket 1 which is also made of steel.

Figure 2:
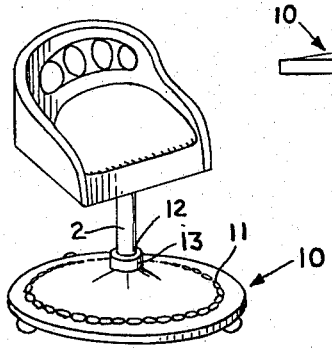
FIG. 2 is a similar view showing the chair of FIG. 1 provided with the shroud of this invention.
Figure 3:
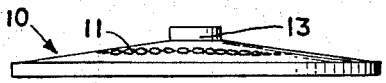
FIG. 3 is a front elevational view of the shroud shown in FIG. 2.
Figure 4:
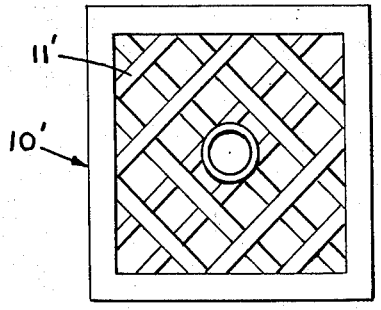
FIGS. 4 and 5 are top plan views of other decorative forms that the shroud may be given.
Figure 8:
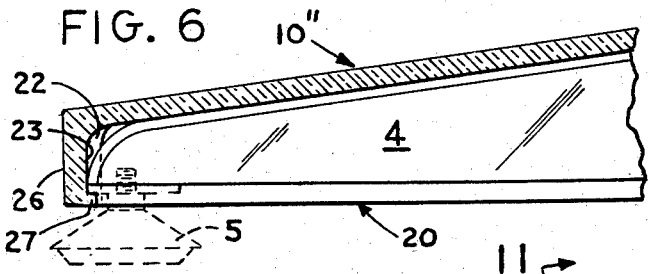
FIG. 8 is a view similar to FIG. 6 showing another method of attaching the shroud to the chair legs.
Figure 10:
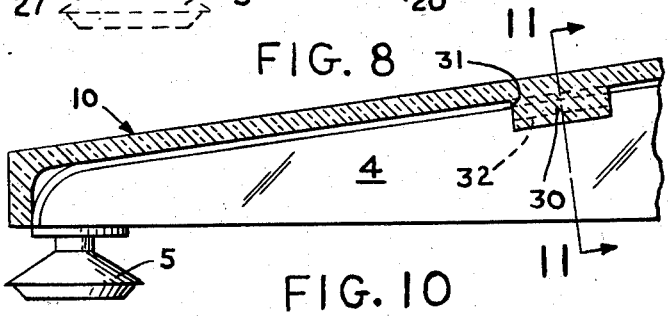
FIG. 10 is a view similar to FIGS. 6 and 8 and showing a further embodiment of the invention.
Figure 9:
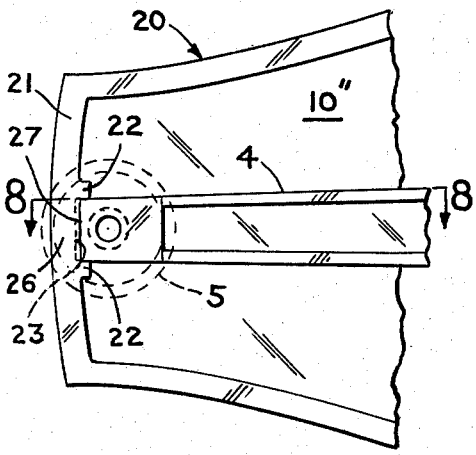
FIG. 9 is a bottom plane view of the shroud and leg portions shown in FIG. 8.
Figure 11:
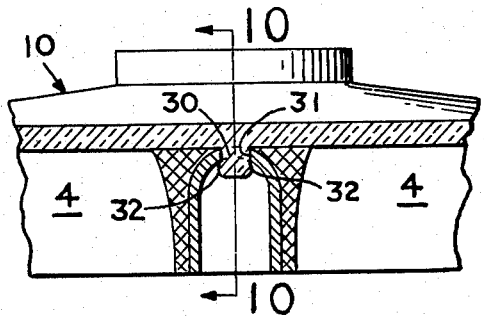
FIG. 11 is a vertical sectional view through the line 11—11 of FIG. 10.

As shown in FIG. 2 of the drawings, in accordance with the invention, the legs 4 of the chair are covered by a shroud 10, which is preferably constituted of a known compressible, resilient plastic having sufficient rigidity to enable the shroud to support the forces created by the user of the chair resting his feet on the shroud or even standing on the shroud as he rises from the chair, and to withstand such forces without damage or destruction. To this end and especially to enable those portions of the shroud spanning the areas between the legs 4 to withstand such forces, the shroud should have a thickness of at least 0.025 and preferably whatever thickness is required of the shroud to provide it with sufficient rigidity to accomplish the purpose for which it was designed. The shroud may be made in any attractive area configuration, such as the circular shape of the shroud 10 in FIG. 2, the square shape of the shroud 10′ shown in FIG. 4 of the drawings, and the cross-like form 10″ illustrated in FIG. 5 of the drawings. In whatever area configuration is selected for the shroud, such configuration is made in the form of a frustum. Thus, the circular shape of shroud 10 is made in a frustro-conical configuration as is shown in FIG. 3 of the drawings. In a like manner the area configurations of the shrouds 10′ and 10″ are made frustum-like. The frustum-like configuration of the shroud is made such that the interior surfaces will seat on substantially the entire lengths of the top surface portions of the legs of the chair for which the shroud has been designed as is shown more clearly in FIGS. 6, 8 and 10 of the drawings and thereby provide a firm seating of the shroud on the chair legs. In addition to the frustum-like area configuration given the shroud, the top surface of the shroud may be attractively painted and provided with ornamental modulated or sculptured designs such as the design 11 shown on the shroud 10, or the embossed and sculptured designs 11, and 11″ shown on the shrouds 10′ and 10″, respectively. The shroud should be made sufficiently large enough in area to entirely conceal the chair legs 4 as is shown in FIGS. 6, 8 and 10 of the drawings.

At its center the shroud is provided with a circular opening 12 through which the pedestal 2 of the chair extends and which is defined by a circular collar or flange 13 that encloses the chair socket 1 and is integral with the body of the shroud. Thus, the shroud of this invention completely conceals the base of the pedestal chair.

The shroud of this invention is securely attached to the chair legs by concealed fastener elements which engage the legs with a snap action. The fastener elements are integral with the body of the shroud and because of the material of which they are formed will give under pressure and will return to the configurations in which they have been molded when the pressure is relieved without taking a permanent set. Preferably, the type of plastic material to be employed in the shroud should have sufficient resiliency that the fastener elements will operate with a snap action and will require the exercise of substantial force to dislodge them from their attached engagement with the chair legs. Any of the well known plastic polystyrenes that are presently manufactured by many well known chemical companies will be satisfactory for making the shrouds of this invention.

Figure 6:
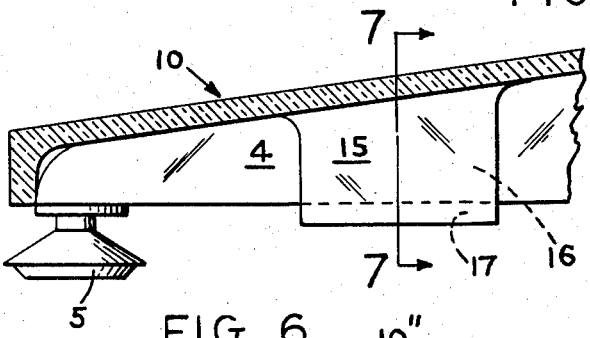
FIG. 6 is a radial vertical sectional view showing a preferred method of attachment of the shroud to the chair legs.
Figure 7:
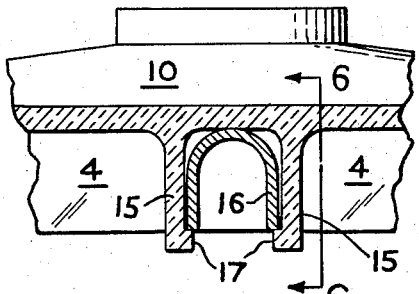
FIG. 7 is a vertical sectional view through the line 7—7 of FIG. 6.

A preferred form of snap fastener arrangement embodying the invention is shown in FIGS. 6 and 7 of the drawings. As indicated, each leg 4 of the chair is engaged by a pair of plate-like members 15, 15 integrally connected at their upper ends to the underside of the shroud 10 and depending in spaced parallel relation therefrom for a distance greater than the vertical dimension of the U-shaped leg 4. The members 15 are spaced apart a distance equal to the outer horizontal dimensions of the hollow leg 4 and with consideration for standard manufacturing tolerances that govern such members. When such members are forced over such leg they will snugly engage the sides of such leg and tightly clamp such enclosed portion of the leg without being substantially spread from their molded configuration. In other words, a part of such clamping action is attained by transverse forces created by the compressive action exerted on the material of the engaged inside faces of the members 15 when such members are forced over the leg portions 16. To this end the members 15 should have a thickness approximating that of the shroud, as is shown in FIG. 7 of the drawings. The border face ends of the members 15 beyond the bottom longitudinal edges of the U-shaped member constituting the chair leg 4 are thickened on the inner sides thereof to an extent of approximately .010–.015 inches to provide opposed convex locking abuttments or projections in the form of beads 17. It will thus be understood, that as the shroud 10 is positioned on the legs 4 with each pair of members 15 properly aligned therewith and then forced downwardly, the beads 17 will initially engage the outer side surfaces of the U-shaped leg portions 16 and cause the members 15 to be yieldably forced apart. When the beads 17 have been pushed past the bottom edges of the leg portions 16 they will snap inwardly holding fast on the leg 16 at the base of the convex locking abutments molded on members 15.

The longitudinal lengths of the legs 15 are sufficiently great, say of the order of 3 to 4 inches, to provide a strong grip of such extent as to render it unlikely that the shroud can be dislodged from its anchored position on the chair even if the applied forces are concentrated on a peripheral portion of the shroud between the chair legs. While the grip afforded by the blind locking plates 15 on the legs 4 is primarily intended to prevent any dislodgement of the shroud 10 from such legs by forces acting on such shroud during usage, such grip cannot readily be broken even by forces applied to such shroud in an upward direction. The shroud however, can readily be removed by applying a relatively minor transverse force on the projections 17 tending to spread the lower ends of the blind locking plates 15 and then applying an upward lifting force on the shroud.

Figure 5:
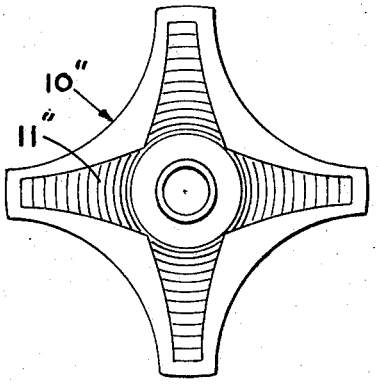

When, as is shown in FIGS. 6–11 of the drawings, the area configuration of the shroud is made large enough to conceal the entire lengths of the legs 4, the pair of blind locking members for each leg, may in addition to being integrally connected at their upper ends to the underside of the shroud, also be integrally connected along their outer edges to the inner sides of a peripheral inwardly directed flange integrally connected to the shroud. The peripheral flange may be a continuous circular member as in the case of a circular shroud such as the circular shroud 10 indicated in FIGS. 6 and 10 of the drawings, or have a different configuration depending on the particular area configuration of the shroud body. Thus, a shroud configured as shown in FIG. 5 of the drawings will have a peripheral flange configured in the manner of the flange 20 shown in FIGS. 8 and 9 of the drawings. The four flange portions 21 concealing the outer ends of the chair legs 4 are made slightly thicker than the body of the shroud to cushion impacts to the shroud during usage and have a vertical dimension slightly greater than the vertical height of the outer ends of the legs 4. The pair of guide members 22,22 integrally connected at their outer edges to the inner side of each flange portion 21 define with the flange portion a centrally located U-shaped pocket 23 for the outer end of a leg 4. The center section 26 of the flange portion 21 defined by the guide members 22,22 is thickened on the inner side thereof to provide a convex locking projection 27 which interlocks with the outer terminal end of the chair leg.

Instead of providing locking members each with a locking projection in the manner of locking members 15,15 and 26, it is within the contemplation of the invention to provide on the shroud for each chair leg a single locking projection formed to provide what may be considered as two locking projections. A locking member of such construction is designated by the reference numeral 30 in FIGS. 10 and 11 of the drawings. The locking member is in the nature of an elongated plug which is integral with and depends from the under surface of the plastic shroud 10. Each plug 30 is located on the shroud so that it will register with an elongated slot 31 provided on a chair leg 4 when the shroud is properly positioned for attachment to the chair legs. It is to be noted that the slot 31 is located between the ends of a chair leg 4, extends longitudinally of the leg and is through the upper central portion of such leg. Adjacent to its juncture with the body of the shroud, the plug 30 has a width approximating the width of the slot 31. Beneath the shroud body at a distance approximating the thickness of the metal material of which the leg is formed, the plug 30 is enlarged cross-sectionally to provide two longitudinally extending side projections 32,32 which have an overall transverse dimension greater than the width of the slot and which interlock with the side edges of the slot 31 to secure the shroud to the leg. In this embodiment of the invention, the longitudinal projections 32,32 will be compressed as the plug 30 if forced through the slot 31. As soon as such projections have passed the sides of the slot they will immediately return to their molded configurations and coact with the sides of the slot to lock the shroud to the chair legs.

What is claimed is:

1. A shroud for a pedestal chair having a plurality of legs extending outwardly from a central pedestal, said shroud comprising a single body member to overlay and entirely conceal all of the legs of the pedestal chair, said body member having a shallow, inverted plate-like configuration and inclining downwardly and outwardly radially from a central opening therein through which the chair pedestal is to extend to provide an inclined planar covering which sets in its entirety upon and over the chair legs, said planar covering body member including radially disposed chair leg planar covering portions having a radial length as great as the length of the chair legs, and intermediate planar covering portions connected to the sides of such leg planar covering portions and spanning the areas between the chair legs to form with said leg planar covering portions an auxiliary, planar, leg concealing chair base of unified configuration different from the overall configuration of the chair legs, said intermediate planar covering portions extending outwardly from the central opening sufficiently to provide a support for the chair user's feet, and said body member being made of material having sufficient rigidity to withstand substantial forces applied to said intermediate spanning planar covering portions thereof by the user during usage of the chair, and a plurality of locking means connected to said body member for releasably locking said planar covering body member in overlying condition upon the legs of the chair, said locking means comprising resilient members located within the outer periphery of said body member and depending downwardly from the underside of said planar covering body member, said resilient members being constituted of resilient material and formed to provide at their lower ends locking elements interlockable with under portions of the chair legs when said body member is pressed down into position upon the chair legs.

2. A shroud for a pedestal chair having a plurality of legs extending outwardly from a central pedestal, said shroud comprising a single body member to overlay and entirely conceal all of the legs of the pedestal chair, said body member having a shallow, inverted plate-like configuration and inclining downwardly and outwardly radially from a central opening therein through which the chair pedestal is to extend to provide radially disposed chair leg covering layer portions having a radial length as great as the length of the chair legs, and intermediate layer portions connected to the sides of such leg covering layer portions and spanning the areas between the chair legs to form with said leg covering layer portions an auxiliary chair base of unified configuration different from the configuration of the chair legs, said body member being made of material having sufficient rigidity to withstand substantial forces applied to said intermediate spanning layer portions thereof by the user during usage of the chair, and a plurality of locking means connected to said body member for releasably locking said body member in overlaying condition to the legs of the chair, each of said locking means comprising a pair of spaced resilient members located within the outer periphery of said body member and intermediate the ends of a said radial leg covering layer portion and depending downwardly from the underside of such layer portion, said resilient members being constituted of resilient material, having substantially radially disposed plate-like body portions engageable with the sides of a chair leg and being provided at their lower ends with locking elements directed in opposed relation for latching under a portion of such chair leg with a snap action when said body member is pressed down into position upon the chair legs.

3. A shroud for a pedestal chair having a plurality of legs extending outwardly from a central pedestal, said shroud comprising a single body member to overlay and entirely conceal all of the legs of the pedestal chair, said body member having a shallow, inverted plate-like configuration and inclining downwardly and outwardly radially from a central opening therein through which the chair pedestal is to extend to provide radially disposed chair leg covering layer portions having a radial length as great as the length of the chair legs, and intermediate layer portions connected to the sides of such leg covering layer portions and spanning the areas between the chair legs to form with said leg covering layer portions an auxiliary chair base of unified configuration different from the configuration of the chair legs, said body member being made of material having sufficient rigidity to withstand substantial forces applied to said intermediate spanning layer portions thereof by the user during usage of the chair, and a plurality of locking means connected to said body member for releasably locking said body member in overlaying condition to the legs of the chair, each of said locking means comprising a resilient transverse member located within the outer periphery of said body member and depending downwardly from the outer periphery of a said radial leg covering layer portion, said member being constituted of resilient material and provided at its lower end with an inwardly directed locking element for interlocking engagement with an under outer end portion of a chair leg when said body member is pressed down into position upon the chair legs, and a pair of vertically disposed spaced ribs formed on the interior side of said depending member and receiving therebetween the outer end of such chair leg, said locking element extending transversely between said vertical ribs.

* * * * *